US007128155B2

(12) United States Patent
Cho

(10) Patent No.: US 7,128,155 B2
(45) Date of Patent: Oct. 31, 2006

(54) CUTTING TOOL AND METHOD OF CUTTING AN OBJECT IN A WELL

(75) Inventor: Brian W. Cho, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 240 days.

(21) Appl. No.: 10/708,998

(22) Filed: Apr. 6, 2004

(65) Prior Publication Data

US 2005/0006102 A1 Jan. 13, 2005

Related U.S. Application Data

(60) Provisional application No. 60/486,834, filed on Jul. 11, 2003.

(51) Int. Cl.
*E21B 29/00* (2006.01)
*E21B 29/04* (2006.01)

(52) U.S. Cl. ..... 166/297; 166/54.5; 166/55; 166/54.6

(58) Field of Classification Search ..... 166/297, 166/298, 381, 54.5, 54.6, 55.1, 55.2
See application file for complete search history.

(56) References Cited

U.S. PATENT DOCUMENTS 3,926,252 A * 12/1975 Ribeyre et al. ..... 166/54.6
4,160,478 A * 7/1979 Calhoun et al. ..... 166/55.1
4,306,622 A 12/1981 Armstrong
4,427,059 A 1/1984 Olivier
4,825,953 A 5/1989 Wong et al.
4,886,115 A 12/1989 Leggett et al.
5,575,331 A 11/1996 Terrell
5,720,348 A 2/1998 Hisaw
6,116,344 A 9/2000 Longbottom et al.
6,135,206 A 10/2000 Gano et al.
6,789,627 B1 9/2004 Leismer
6,805,197 B1 10/2004 Brumley et al.
2004/0251027 A1 12/2004 Sonnier et al.
2005/0006102 A1 1/2005 Cho

* cited by examiner

*Primary Examiner*—David Bagnell
*Assistant Examiner*—Robert Fuller
(74) *Attorney, Agent, or Firm*—Robert A Van Someren; Kevin P. McEnaney; Jaime A. Castano

(57) ABSTRACT

A cutting device cuts one or more downhole control lines such that the cut ends of the one or more control lines will not interfere with subsequent fishing operations. The cutting device comprises a mandrel, a cutting sleeve and a housing supported on a tubing. Movement of the tubing induces relative motion of the cutting sleeve to cut the one or more control lines.

19 Claims, 5 Drawing Sheets

SECTION B-B

SECTION C-C

SECTION D-D

SECTION E-E

SECTION A-A

CUTTING TOOL AND METHOD OF CUTTING AN OBJECT IN A WELL

CROSS REFERENCE TO RELATED APPLICATIONS

This application claims the benefit of U.S. Provisional Application No. 60/486,834, filed Jul. 11, 2003.

BACKGROUND OF INVENTION

1. Field of Invention

The present invention relates to the field of cutting tools, particularly to a device and method to cut a control line downhole in a well.

2. Related Art

With the advent of intelligent completions, running multiple control lines downhole along completions equipment is common practice. Unfortunate occurrences sometimes require cutting the downhole tubing to retrieve the completion equipment. In those cases, the control lines can complicate the retrieval operations if the control lines are pulled apart above the tubing cut. Ideally, the control lines are cut below the tubing cut to recover as much of the control lines as possible and leave a clean "fish" downhole.

Prior systems use a "splice sub" in which the control lines are anchored above and below the tubing cutting target length. A tubing cutter such as an Explosive Jet Cutter (EJC) is run to target depth and detonated to cut the tubing. Excess impact from the EJC at least partially cuts the control lines. When the tubing is removed, the control lines, if not completed severed, break at the damaged area, leaving the remaining control line portions in the vicinity of the remaining tubing. The remaining tubing is more easily "fished" if it is clear of control line remnants.

SUMMARY OF INVENTION

The present invention provides for a cutting device and associated method to cut one or more downhole control lines such that the cut ends of the control lines will not interfere with subsequent fishing operations.

DETAILED DESCRIPTION

Figure 1:
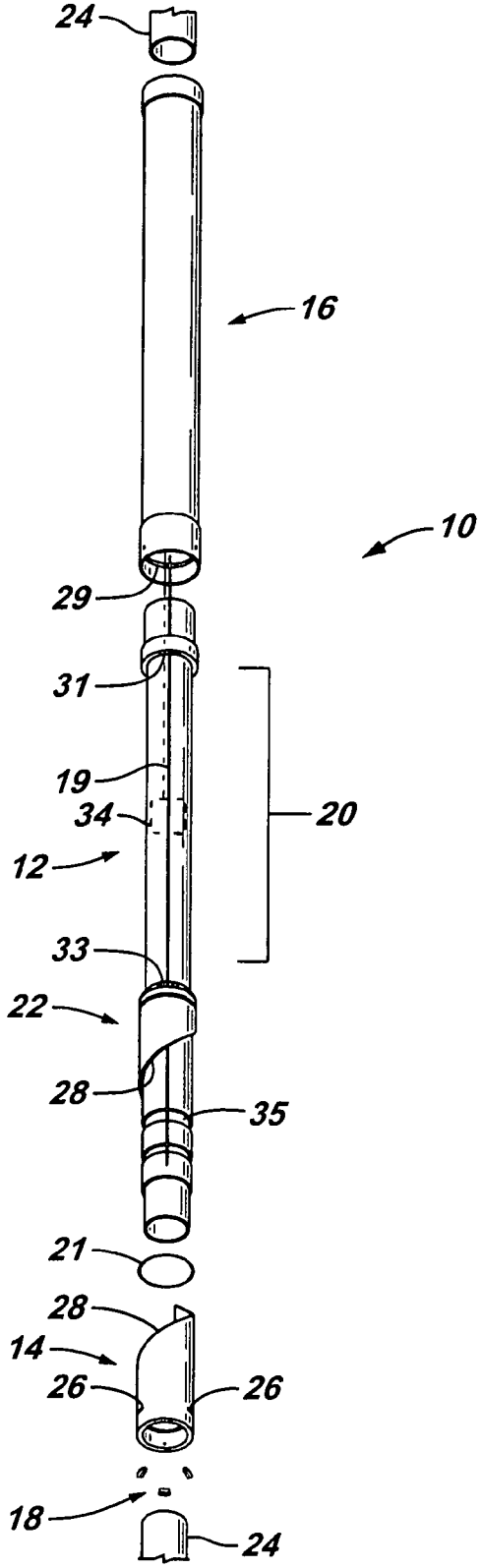
FIG. 1 shows an exploded perspective view of a cutting tool constructed in accordance with the present invention.

Referring to FIG. 1, a cutting tool 10 comprises four primary components: a mandrel 12, a cutting sleeve 14, a housing 16, and lugs 18. FIG. 1 also shows a single control line 19, though the invention is not limited to just one control line. Other figures (e.g., FIGS. 3 and 4) show, for example, five control lines 19. Control line 19 may be, for example, a hydraulic conduit, an electric cable, a fiber optic cable, or a combination of those, as well as other devices manifested as a relatively small diameter longitudinal line. A seal 21 is mounted near the lower end of mandrel 12 and serves to prevent the upward invasion of dust and debris.

In FIG. 1, housing 16 is shown retracted from its operational configuration to expose the underlying components. Housing 16 normally encloses mandrel 12 and sleeve 14. Mandrel 12 provides a tubing cutting target 20 and carries a cutting base 22 near its lower end below target 20. Base 22 can be integral to mandrel 12 or can be made as a separate component and attached to mandrel 12. Mandrel 12 mounts at its upper end to an upper end of housing 16, and at its lower end to a lower portion of a tubing 24. Housing 16 attaches at its upper end to an upper portion of tubing 24. Tubing 24, housing 16, and mandrel 12, when so assembled, form a continuous passageway for fluid flow.

Sleeve 14 is carried on the lower end of mandrel 12 and can move in both rotation and translation relative to mandrel 12 and base 22. The relative motion provides a cutting action. Base 22 and sleeve 14 have mating helical surfaces 28 and each has a longitudinal passageway through its respective sidewall to accommodate control line 19. Those passageways are initially aligned. Axial holes 31 in mandrel 12 and axial holes 33 in base 22 of FIG. 1 show the passageway openings accommodating control line 19.

Lugs 18 are carried in slots 26 of sleeve 14 and placed in sliding engagement with the lower end of mandrel 12. Lugs 18 extend into a groove 29 in the inner surface of housing 16, linking sleeve 14 to housing 16 while permitting sleeve 14 to rotate relative to housing 16. A recess 35 in mandrel 12 allows lugs 18 to disengage from housing 16 upon sufficient displacement of sleeve 14.

In operation, a tubing cutter 34 such as an explosive jet cutter is placed in the vicinity of tubing cutting target 20. The cutter 34 is actuated to sever mandrel 12 somewhere along the length of target 20. Once mandrel 12 is severed, the upper portion of tubing 24 is pulled upward by the operator. Because housing 16 is attached to the upper portion of tubing 24, housing 16 is pulled upward as well. Since lugs 18 extend into groove 29 of housing 16, sleeve 14 is also pulled upward. Thus, housing 16 provides a mechanical link between the upper portion of tubing 24 (that has now been severed from the lower portion of tubing 24) and cutting sleeve 14 to generate the relative motion required for cutting control line 19.

Helical surfaces 28 between sleeve 14 and cutting base 22 cause sleeve 14 to rotate relative to base 22 when sleeve 14 is pulled upward. The rotational motion advances the cutting edge of sleeve 14 through control line 19, thereby cutting control line 19. With sufficient upward travel of cutting sleeve 14, lugs 18 encounter and retract into recess 35 in mandrel 12 to release housing 16.

Once housing 16 is released, the upper portion of tubing 24, along with housing 16 and the upper portion of (severed) mandrel 12 can all be removed from the well. The newly cut end of the upper portion of control line 19 is enclosed inside housing 16 during retrieval. The severed end of the lower portion of control line 19 left in the well is enclosed inside sleeve 14. The lower portion of tubing 24 remains in the well and the uppermost end of the severed lower portion of mandrel 12 is clear of control lines 19. Preferably the severed end of mandrel 12 is beveled to allow for easy overshoot. Additionally, the outside diameter of sleeve 14 is preferably small enough to be swallowed up (i.e., enclosed and captured), for example, by a burner mill. This allows for removal of the remaining portion of the completion assembly from the well.

Figure 2:
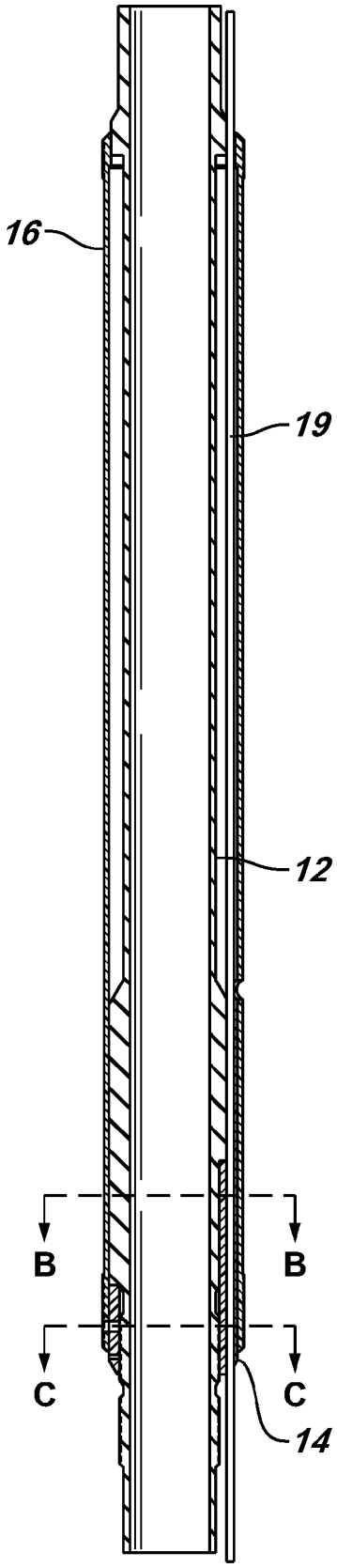
FIG. 2 shows a cross-sectional view of an eccentric embodiment of the cutting tool of FIG. 1.
Figure 3:
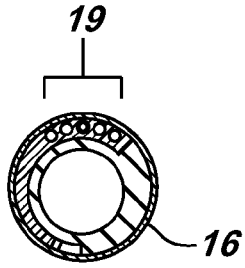
FIG. 3 shows a first sectional view of the cutting tool of FIG. 2.
Figure 4:
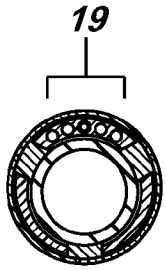
FIG. 4 shows a second sectional view of the cutting tool of FIG. 2.

FIGS. 2–4 show an embodiment of cutting tool 10 in which the elements are eccentrically aligned. The eccentric design accommodates more or larger control lines 19.

Figure 5:
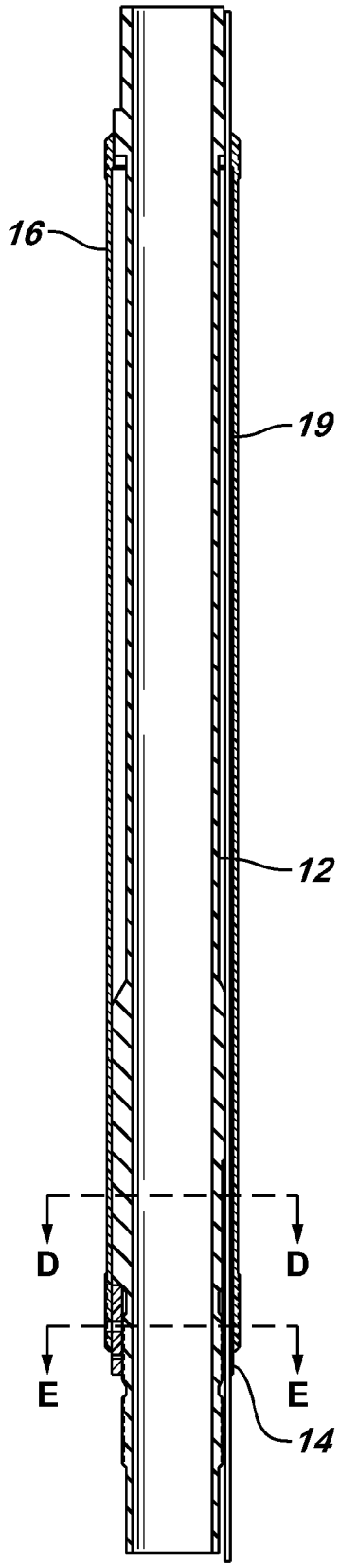
FIG. 5 shows a cross-sectional view of a concentric embodiment of the cutting tool of FIG. 1.
Figure 6:
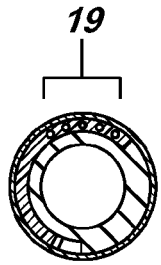
FIG. 6 shows a first sectional view of the cutting tool of FIG. 5.
Figure 7:
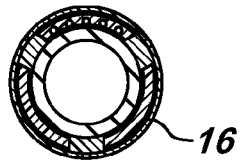
FIG. 7 shows a second sectional view of the cutting tool of FIG. 5.

FIGS. 5–7 show an embodiment of cutting tool 10 in which the elements are concentrically aligned. When requirements permit, a concentric design allows for simpler manufacture.

Figure 8:
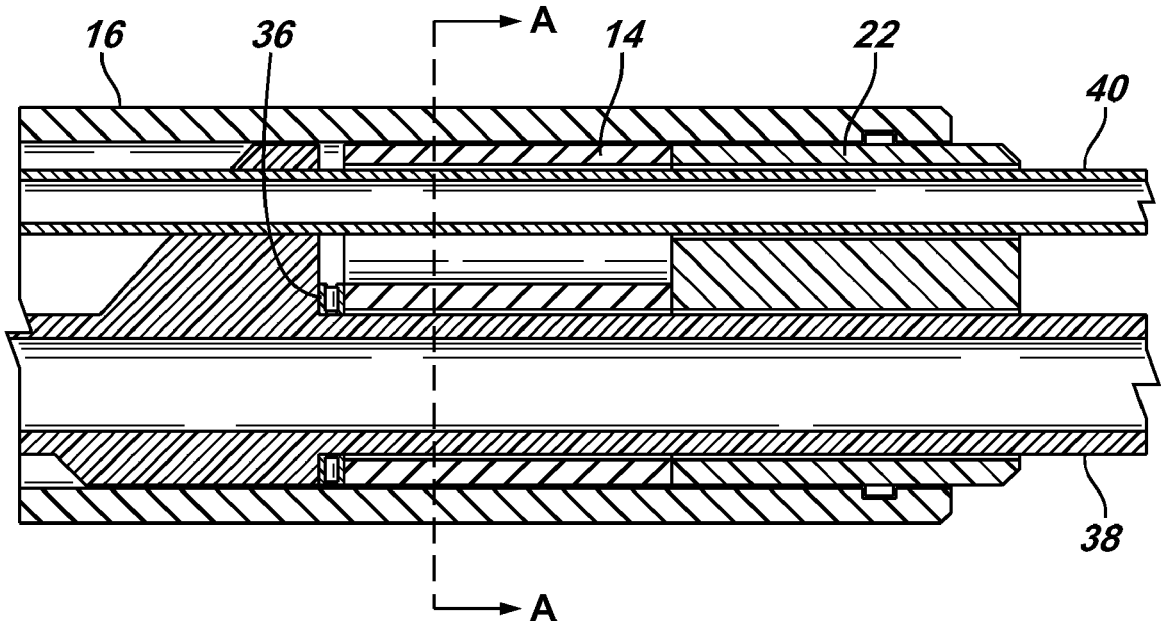
FIG. 8 shows a cross-sectional view of an alternate embodiment of the cutting tool of FIG. 1 in which dual tubing is used.
Figure 9:
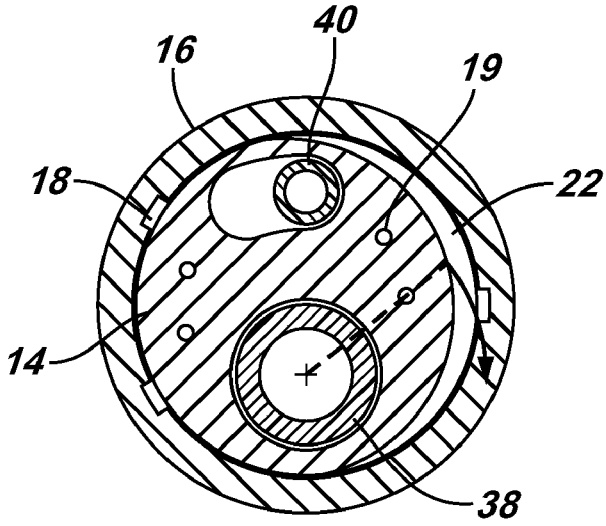
FIG. 9 shows a sectional view of the cutting tool of FIG. 8.
Figure 10:
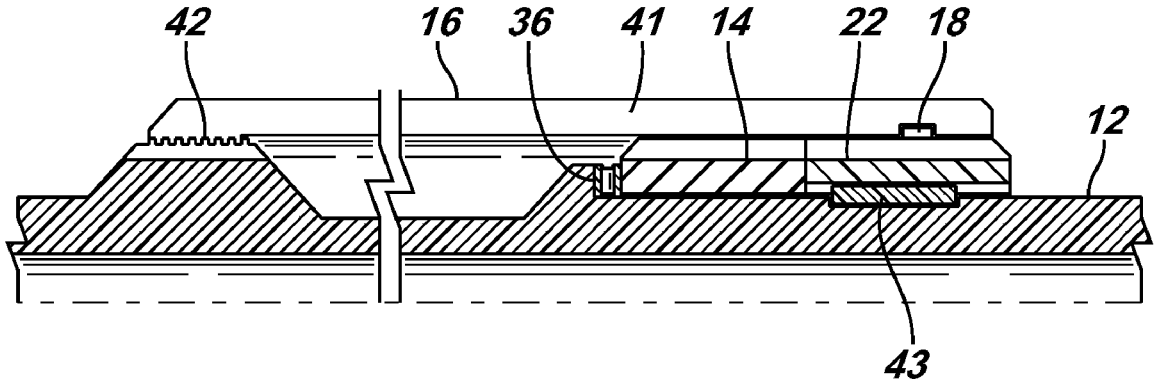
FIG. 10 shows a cross-sectional view of an alternate embodiment of the cutting tool of FIG. 1.

FIGS. 8–10 show alternative embodiments of cutting tool 10 in which the roles of cutter sleeve 14 and base 22 are reversed. A thrust bearing 36 is placed above cutter sleeve 14 to better allow sleeve 14 to rotate. Base 22 can be integral to mandrel 12 or can be made as a separate component and attached to mandrel 12. Base 22 and cutter sleeve 14 remain the two arms of the scissors and their helical profiles induce relative rotation between them. They can be manufactured from the same tube to ensure a conformable mating surface. The roles are reversed because the lower portion (base 22) is now fixed to mandrel 12. The upper portion (sleeve 14) is now the component that rotates.

FIGS. 8 and 9 show an embodiment in which dual tubing strings are used. Primary string 38 and secondary string 40 mount in a fashion similar to that described above to housing 16 and mandrel 12. If it becomes necessary to cut control lines 19, tubing strings 38, 40 are first cut as before. Gaps in sleeve 14 around string 40 and within housing 16 allow sleeve 14 to rotate, cutting control lines 19.

FIG. 10 also shows other features such as housing 16 having a channel 41 along its entire length such that housing 16 effectively forms a "C-ring". That allows control lines 19 to be laid through channel 41 alongside mandrel 12 without regard to alignment holes 31. Channel 41 in housing 16 is rotated to align with the channels (instead of holes 33) in the base 22 and cutter sleeve 14 and control lines 19 are installed through the channels one line at a time. Housing 16 can then be rotated over control lines 19 to protect them from external hazards in the well. To avoid hoop stresses in housing 16, square threads 42 and square lugs 18 are preferred. Lugs 18 may also need to be spring loaded to insure proper retraction from housing 16. Base 22 can be restrained by clutch 43 to limit the motion of base 22 to translation only.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words "means for" together with an associated function.

The invention claimed is:

1. A cutting tool to cut
an object in a well comprising:
a mandrel having a base mounted thereon, the mandrel having an upper end and a lower end;
a sleeve carried on the mandrel, the sleeve having a contoured profile that mates with a contoured profile on the base and in which the object passes through the base and the sleeve;
a housing mounted to the upper end of the mandrel and releasably engaged with the sleeve to impart a force on the sleeve when the housing is pulled upward such that the sleeve rotates as it tracks the contoured profile on the base and thereby cuts the object; and
one or more lugs that releasably engage the sleeve to the housing.

2. The cutting tool of claim 1 in which the contoured profiles are helixes.

3. The cutting tool of claim 1 further comprising one or more slots in the sleeve to carry the one or more lugs.

4. The cutting tool of claim 1 further comprising a groove in the housing into which the one or more lugs extend.

5. The cutting tool of claim 1 further comprising a recess in the mandrel into which the one or more lugs retract to release the sleeve from the housing.

6. The cutting tool of claim 1 in which the mandrel has a severable zone above the base.

7. The cutting tool of claim 1 further comprising an upper tubing connected to an upper end of the housing and a lower tubing connected to the lower end of the mandrel.

8. The cutting tool of claim 1 in which the object is a control line.

9. The cutting tool of claim 1 in which the object is a hydraulic conduit, an electric cable, a fiber optic cable, or a plurality of those in any combination.

10. The cutting tool of claim 1 in which there are a plurality of objects.

11. A completion apparatus for use in a subterranean well comprising: an upper tubing;
a housing mounted to the upper tubing;
a mandrel mounted to and enclosed by the housing, the mandrel having a severable zone;
a base moveably mounted on the mandrel and releasably mounted to the housing, the base having a contoured edge;
a sleeve rotatably mounted on the mandrel above the base, the sleeve having a mating contoured edge such that translation of the base induces relative, circumferential rotation between the sleeve and the mandrel;
a line passing along the upper tubing, the housing, and through passageways in the base and the sleeve; and
a lower tubing mounted to the mandrel.

12. The completion apparatus of claim 11 in which the line is a hydraulic conduit, an electric cable, or a fiber optic cable.

13. The completion apparatus of claim 11 in which the housing has a channel along its length through which the line is placed.

14. The completion apparatus of claim 11 in which the base and sleeve have channels in which the line initially resides.

15. The completion apparatus of claim 11 in which square threads are used to mount the housing to the mandrel.

16. The completion apparatus of claim 11 in which a thrust bearing supports the sleeve.

17. The completion apparatus of claim 11 in which a clutch resides between the base and the mandrel.

18. The completion apparatus of claim 11 in which the sleeve and base are manufactured from a single tube.

19. A method to cut an object in a well comprising:

placing a tubing cutter in the vicinity of a severable zone in a mandrel;

severing the mandrel with the tubing cutter;

pulling upward on a housing, the housing being connected both to the mandrel above where the mandrel was severed and to a sleeve moveably carried on the mandrel below where the mandrel was severed;

cutting the object by rotating the sleeve, the sleeve being rotated in response to the upward pull of the housing.

* * * * *